US007992220B1

(12) United States Patent
McGoldrick

(10) Patent No.: US 7,992,220 B1
(45) Date of Patent: Aug. 9, 2011

(54) PROTECTIVE BURP CLOTH

(76) Inventor: Sheila McGoldrick, Croydon, PA (US)

( * ) Notice: Subject to any disclaimer, the term of this patent is extended or adjusted under 35 U.S.C. 154(b) by 297 days.

(21) Appl. No.: 12/167,209

(22) Filed: Jul. 2, 2008

(51) Int. Cl.
*A41D 13/08* (2006.01)

(52) U.S. Cl. ..... 2/46; 2/160

(58) Field of Classification Search ..... 2/104, 46, 2/158, 159, 160, 59, 49.2, 50, 48, 125, 126, 2/161.1, 161.5, 161.6, 16, 169, 170, 162, 2/60; D2/858, 610–612, 614, 623; 446/26, 446/327, 328
See application file for complete search history.

(56) References Cited

U.S. PATENT DOCUMENTS

| | | | | | |
|---|---|---|---|---|---|
| 1,478,914 | A | * | 12/1923 | Ritzenthaler | 15/227 |
| 1,583,041 | A | * | 5/1926 | Herrick | 224/218 |
| 1,670,176 | A | * | 5/1928 | Woolery | 116/35 R |
| 2,223,029 | A | * | 11/1940 | Dunton | 2/160 |
| 2,534,313 | A | * | 12/1950 | Starkey | 116/200 |
| 3,308,479 | A | * | 3/1967 | Sesco, Jr. | 2/50 |
| 4,651,349 | A | * | 3/1987 | Heiler | 2/104 |
| 4,873,725 | A | * | 10/1989 | Mitchell | 2/48 |
| D315,845 | S | * | 4/1991 | Lafley | D6/601 |
| 5,008,960 | A | | 4/1991 | Hemming | |
| 5,361,435 | A | * | 11/1994 | Reeves | 5/419 |
| 5,893,171 | A | * | 4/1999 | Ries | 2/48 |
| 5,924,612 | A | * | 7/1999 | Boedeker | 224/158 |
| D422,397 | S | * | 4/2000 | Cohen | D2/858 |
| 6,523,180 | B1 | * | 2/2003 | Christopher | 2/59 |
| 7,048,160 | B2 | * | 5/2006 | Anderson | 224/148.6 |
| 7,131,156 | B1 | * | 11/2006 | Walker-Craft | 5/655 |
| 7,251,838 | B1 | * | 8/2007 | Rumbaugh et al. | 2/160 |
| 7,520,074 | B1 | * | 4/2009 | Vanova | 40/586 |
| 2007/0157357 | A1 | | 7/2007 | Cymbol | |
| 2007/0239123 | A1 | | 10/2007 | Pressler | |
| 2009/0298378 | A1 | * | 12/2009 | Segal | 446/26 |

* cited by examiner

*Primary Examiner* — Amy B Vanatta
(74) *Attorney, Agent, or Firm* — LaMorte & Associates

(57) ABSTRACT

A burp cloth device that is designed to protects a mother's hand while feeding and burping an infant. In this manner, the amount of an infant's spit-up that contacts the mother's hand is limited and the mother's skin need not become irritated by the contact with stomach acid or the need for excess washing. The burp cloth device has a hand pouch that defines an open interior. The hand pouch has at least one side opening that provides access into the open interior by a user's hand. A cloth panel extends below the hand pouch. The cloth panel has side edges that extend downwardly to a free hanging end. Secondary features, such as a catch pocket, protruding tabs and teething surfaces can be added to the cloth panel.

5 Claims, 2 Drawing Sheets

PROTECTIVE BURP CLOTH

BACKGROUND OF THE INVENTION

1. Field of the Invention

In general, the present invention relates to burp cloths that are used to protect a person from an infant's spit-up when the infant is being held and burped. More particularly, the present invention relates to the structure of such burp cloths and the optional features incorporated into the design of the burp cloth.

2. Prior Art Description

It is well known that the digestive track of an infant is not well developed. Accordingly, many infants regurgitate the milk they consume. Although the regurgitation comes from an infant, it does contain some amount of stomach acids. Many people have skin that is sensitive to such acids. This is especially true among mothers of newborn children who tend to wash their hands more than usual, thereby developing dry, cracked skin.

In the prior art, a wide variety of burp cloths have been developed that are designed to protect a person from the regurgitations of an infant. However, most burp clothes are designed to be placed over the shoulder when the infant is burped while being held over the shoulder. In this manner, the burp cloth protects the shoulder of the caregiver's clothes from being contacted and stained from the spit-up. Such prior art burp cloths are exemplified by U.S. Pat. No. 5,008,960 to Hemming, entitled Nursing Garmet, and U.S. Patent Application Publication No. 2007/0239123 to Pressler, entitled Multi-Purpose Cloth For Use With Infants And Children.

Other burp cloths are designed to be placed on an infant, like a bib. Such burp cloths protect the infant's clothes from being stained from spit-up, but offers little protection to the mother while the infant is being burped. Infant burp cloths with spit-up catch pockets are exemplified by U.S. Patent Application Publication No. 2007/0157357, entitled Multi-Purpose Cloth For Use With Infants And Children.

Although prior art burp cloths do protect an infant's clothes and a mother's clothes from spit-up, prior art burp cloth designs do little to protect a mother's hand. A need therefore exists for a burp cloth design that both protects clothing from spit-up and also protects the skin of a mother's hand. This need is met by the present invention as described and claimed below.

SUMMARY OF THE INVENTION

The present invention is a burp cloth device that is designed to protect a mother's hand while feeding and burping an infant. In this manner, the amount of an infant's spit-up that contacts the mother's hand is limited and the mother's skin need not become irritated by the contact with stomach acid or the need for excess washing.

The burp cloth device includes a hand pouch that defines an open interior. The hand pouch has at least one side opening that provides access into the open interior by a user's hand. A cloth panel extends below the hand pouch. The cloth panel has side edges that extend downwardly to a free hanging end. Secondary features, such as a catch pocket, protruding tabs and teething surfaces can be added to the cloth panel.

During feeding and burping, a mother places her hand inside the hand pouch and supports the infant with that same hand. In this manner, if the infant spits up, the cloth panel protects clothes while the hand pouch provides protection to the mother's hand.

BRIEF DESCRIPTION OF THE DRAWINGS

For a better understanding of the present invention, reference is made to the following description of an exemplary embodiment thereof, considered in conjunction with the accompanying drawings, in which.

DETAILED DESCRIPTION OF THE DRAWINGS

Figure 1:
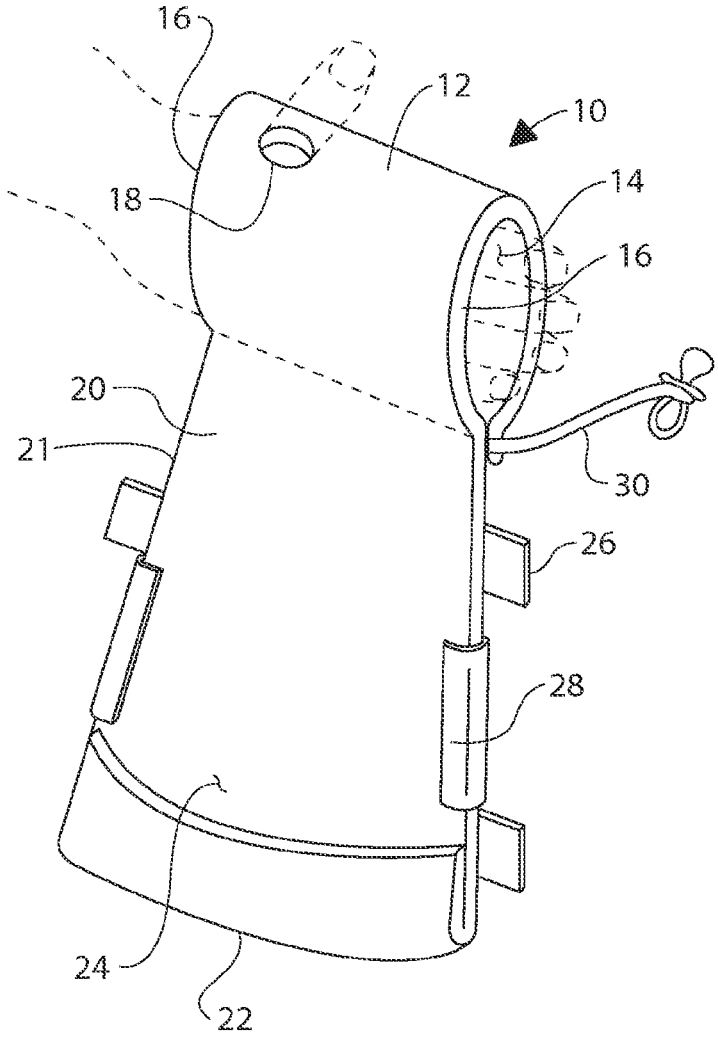
FIG. 1 is a perspective view of an exemplary embodiment of a burp cloth device.

Referring to FIG. 1, an exemplary embodiment of a burp cloth assembly 10 is shown. The burp cloth assembly 10 is designed to protect the hand of the mother or caregiver who is holding the infant. In this manner, people with sensitive skin are protected from contact with the infant's spit-up should the infant regurgitate some food. Likewise, the infant is protected from jewelry on the caregiver's hand which may accidentally scratch the infant's skin or draw the attention of the infant.

The burp cloth assembly 10 defines a hand pouch 12. The hand pouch 12 is a cylindrical tube of cloth that is oriented horizontally. As such, the hand pouch 12 defines a protected open interior 14. The sides of the hand pouch 12 are open. The side openings 16 have a diameter of between three and six inches so that a person can comfortably pass his/her hand through the side openings. It will therefore be understood that a person can place their hand into the protected open interior 14 from either side opening 16 on the hand pouch 12.

At least one thumbhole 18 may be formed at the top of the hand pouch 12. The optional thumbhole 18 enables a person's thumb to extend outside of the hand pouch 12 while the remainder of their hand remains inside the hand pouch 12. By enabling a person's thumb to extend outside the hand pouch 12, it will be understood that a person can better grab and hold objects, such as a baby bottle, without removing their hand from the hand pouch 12.

A cloth panel 20 extends below the hand pouch 12. The cloth panel 20 has side edges 21 that extend from the hand pouch 12 down to a free hanging end 22. A catch pocket 24 is formed at the free hanging end 22. The catch pocket 24 is intended to catch any spit-up that an infant may regurgitate onto either the hand pouch 12 or the cloth panel 20.

An infant is typically held and burped a few times during a feeding. The burp cloth assembly 10 is placed on a caregiver's hand to protect both that hand and the infant during burping. However, the burp cloth assembly 10 need not be removed when the infant has been burped and is feeding. In this scenario, a person holds the hand with the burp cloth assembly 10 in front of the infant. Once in this position, the burp cloth assembly 10 serves as a bib and the infant is capable of grabbing the cloth panel 20.

Protruding tabs 26 may optionally be added to the side edges 21 of the cloth panel 20. The protruding tabs 26 can be made of materials having different textures. The protruding tabs 26 provide easy elements for an infant to grab and hold as the infant feeds, thereby helping to calm the infant during feeding intervals.

Teething surfaces 28 can also be added to the cloth panel 20. The teething surfaces 28 are segments of elastomeric material, such as synthetic rubber, that are sewn or glued onto the cloth panel 20. Preferably, the teething surfaces 28 are located along the side edges 21 of the cloth panel 20. In this manner, an infant grabbing the cloth panel 20 would be able to easily bite upon the teething surfaces 28.

The cloth panel 20 usually hangs at full length. Optional patched of hook and loop material, such as Velcro®, can be sewn on the back surface of the cloth panel. The hook and loop material enables the cloth panel to be partially folded and shortened to any desired length.

In addition to the teething surfaces 28 and protruding tabs 26, an optional tether 30 may be attached to the burp cloth assembly 10. The tether 30 has a first end 32 that is sewn to the structure of the burp cloth assembly 10. The free end 34 of the tether 30 contains hook and loop material 36 so that the tether can be closed into a loop. This enables the free end 34 of the tether 30 to engage a secondary object, such as a rattle or a pacifier.

Figure 2:
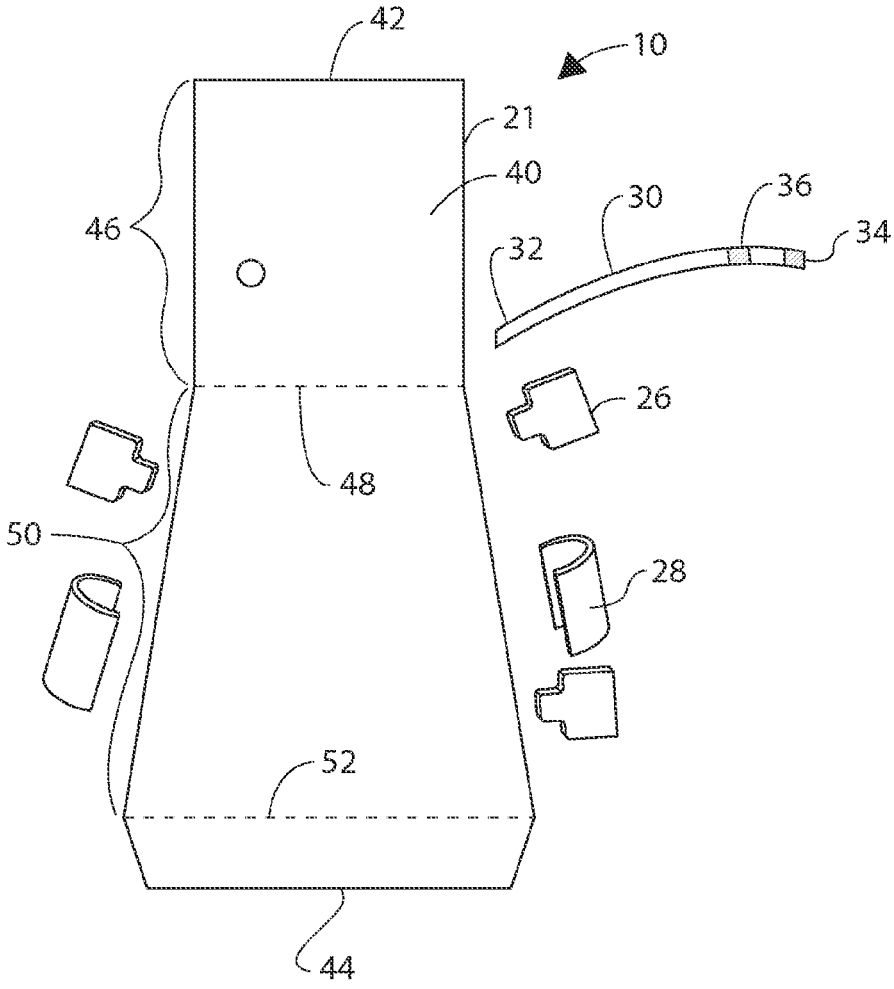
FIG. 2 is an exploded view of the embodiment of FIG. 1.

Referring to FIG. 2, it can be seen that the burp cloth assembly 10 is fabricated primarily from a single piece of fabric 40. The piece of fabric 40 is preferably a high-nap cotton weave or similar fabric type used in the production of absorbent cloth towels. The piece of fabric 40 has a first end 42, a second end 44, wherein the opposing side surfaces 21 extend between the first end 42 and the second end 44.

In a preferred construction, the piece of fabric 40 has a complex shape. The piece of fabric 40 has a straight section 46 extending from the first end 42 to a seam line 48. In the straight section 46, the piece of fabric 10 has a uniform width. Accordingly, the side edges 21 are parallel as they extend along the straight section 46.

The piece of fabric 40 has a tapered section 50 that extends from the seam line 48 to a pocket fold line 52. In the tapered section 50, the width of the piece of fabric 10 expands and the side edges 21 diverge as they approach the pocket fold line 52. Lastly, below the pocket fold line 52, the side edges 21 of the piece of fabric 40 begin to converge as they approach the second end 44 of the piece of fabric 40.

In manufacture, the straight section 46 of the piece of fabric 40 is folded over to form the hand pouch 12. The first end 42 of the piece of fabric 40 folds into contact with the first seam line 48 and is sewn in place. The side edges 21 of the straight section 46 are left open to create the side openings 16 in the hand pouch 12.

The optional tether 30 can be attached to the piece of fabric 40 by sewing its first end 32 into the seam line 48.

The piece of fabric 40 is folded upwardly at the pocket fold line 52. The overlapping side edges 21 created by the fold are then sewn together. This creates the catch pocket 24 at the bottom of the piece of fabric 40.

The optional protruding tabs 26 and teething surfaces 28 can then be either sewn or adhered to the piece of fabric 40 to complete the burp cloth assembly 10.

It will be understood that the embodiment of the present invention that is illustrated and described is merely exemplary and that a person skilled in the art can vary the exemplary embodiment in many ways. For instance, the shape and size of the burp cloth assembly can be altered. Furthermore, a variety of different material can be used in the production of the burp cloth assembly. Likewise, the burp cloth assembly can be made from separate components rather than from a single piece of fabric. All such variations, modifications and alternate embodiments are intended to be included within the scope of the present invention as described and claimed below.

What is claimed is:

1. An infant burp cloth device that protects a person's hand between the person's thumb and fingertips, said infant burp cloth device comprising:

a single piece of fabric having a first end, and opposite second end and two side edges that run between said first end and said second end, said single piece of fabric having a straight section that extends from said first end to a first line, a tapered section that extends from said first line to a second line and a reverse tapered section that runs from said second line to said second end;

wherein a thumbhole is formed through said single piece of fabric in said straight section;

wherein said first end of said single piece of fabric is folded over to said first line and sewn with a seam along said first line, therein forming said straight section into a cylindrical hand pouch having two open sides, wherein said hand pouch is sized so that when the person's hand is in said cylindrical hand pouch and the thumb extends through said thumb hole, the fingertips extend beyond one of said open sides of said cylindrical hand pouch; and wherein said thumbhole is disposed in said cylindrical pouch at a top point opposite said tapered section; and wherein said second end is folded to said second line to form a catch pocket with an opened top that faces toward said hand pouch.

2. The device according to claim 1, further including at least one protruding tab extending outwardly from one of said side edges of said piece of fabric.

3. The device according to claim 1, further including at least one teething surface affixed to said piece of fabric.

4. The device according to claim 1, further including a tether having an anchored end and a free end, wherein said anchored end is affixed to said piece of fabric along said seam.

5. The device according to claim 4, wherein a connector is disposed on said free end of said tether to enable said free end to be connected to a secondary object.

* * * * *